US011933568B2

(12) United States Patent
Hammel et al.

(10) Patent No.: US 11,933,568 B2
(45) Date of Patent: Mar. 19, 2024

(54) INTERCHANGEABLE MODULAR CHAMBER SYSTEM FOR A FIREARM

(71) Applicant: The United States of America, as represented by the Secretary of the Navy, Crane, IN (US)

(72) Inventors: Rand W. Hammel, Springville, IN (US); Alex J. Toon, Odon, IN (US); Donald Richardville, Montgomery, IN (US)

(73) Assignee: The United States of America, as Represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 17/714,219

(22) Filed: Apr. 6, 2022

(65) Prior Publication Data

US 2022/0316836 A1 Oct. 6, 2022

Related U.S. Application Data

(60) Provisional application No. 63/171,196, filed on Apr. 6, 2021.

(51) Int. Cl.

| | |
|---|---|
| ***F41A 21/48*** | (2006.01) |
| ***F41A 21/10*** | (2006.01) |
| ***F41A 21/12*** | (2006.01) |
| ***F41A 21/18*** | (2006.01) |

(52) U.S. Cl.

CPC ..... *F41A 21/482* (2013.01); *F41A 21/10* (2013.01); *F41A 21/12* (2013.01); *F41A 21/18* (2013.01)

(58) Field of Classification Search

CPC ..... F41A 21/04; F41A 21/10; F41A 21/12; F41A 21/482

See application file for complete search history.

(56) References Cited

U.S. PATENT DOCUMENTS 1,355,421 A * 10/1920 Pedersen ..... F41A 21/18 42/78
1,355,422 A * 10/1920 Pedersen ..... F41A 21/18 42/76.01
1,748,272 A * 2/1930 McCann ..... F41A 21/04 89/16

(Continued)

FOREIGN PATENT DOCUMENTS

DE 713008 C * 10/1941
DE 2045738 A1 * 3/1972
FR 621348 A * 5/1927

*Primary Examiner* — Gabriel J. Klein

(74) *Attorney, Agent, or Firm* — Naval Surface Warfare Center, Crane Division; Christopher Feigenbutz

(57) ABSTRACT

Provided is an interchangeable modular chamber system for a firearm. The system includes a firearm receiver, a barrel comprising lands and grooves, a chamber insert sleeve comprising lands and grooves, an index pin, a locking collar, and a recoil lug. The barrel is threaded into the receiver with the chamber insert sleeve positioned within the barrel. The chamber insert sleeve is indexed to align the lands and grooves of the chamber insert sleeve with those of the barrel. The locking collar and recoil lug are threaded onto the external threads of the barrel and are adjustable to optimize the headspace for different cartridges of the same caliber and to allow for the sacrificial replacement of the throat area of a barrel.

16 Claims, 7 Drawing Sheets

(56) References Cited

U.S. PATENT DOCUMENTS

| | | | | | |
|---|---|---|---|---|---|
| 2,362,996 | A * | 11/1944 | Green | F41A 21/26 | 89/14.3 |
| 2,609,631 | A * | 9/1952 | Garand | F41A 21/04 | 42/76.01 |
| 2,849,923 | A * | 9/1958 | Cotterman | F41A 21/04 | 42/76.01 |
| 2,850,828 | A * | 9/1958 | Sullivan | F41A 21/04 | 42/76.02 |
| 3,442,172 | A * | 5/1969 | Lorenz | F41A 21/04 | 42/76.01 |
| 3,468,211 | A * | 9/1969 | Suan | F16B 35/00 | 411/397 |
| 3,748,957 | A * | 7/1973 | Arnold | F41A 21/04 | 42/76.01 |
| 5,479,737 | A * | 1/1996 | Osborne | F41A 21/12 | 89/14.05 |
| 8,230,633 | B1 * | 7/2012 | Sisk | F41C 23/06 | 42/75.01 |
| 2016/0116251 | A1 * | 4/2016 | Mather | F41C 23/16 | 42/71.01 |
| 2019/0086175 | A1 * | 3/2019 | Karagias | F41A 21/482 | |

* cited by examiner

INTERCHANGEABLE MODULAR CHAMBER SYSTEM FOR A FIREARM

CROSS-REFERENCE TO RELATED APPLICATIONS

The present application claims priority to U.S. Provisional Patent Application Ser. No. 63/171,196, filed Apr. 6, 2021, entitled "MODULAR CHAMBERED RIFLE SYSTEM," the disclosure of which is expressly incorporated by reference herein.

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon. This invention (Navy Case 2005601.7502) is assigned to the United States Government and is available for licensing for commercial purposes. Licensing and technical inquiries may be directed to the Technology Transfer Office, Naval Surface Warfare Center Crane, email: Cran_CTO@navy.mil.

FIELD OF THE INVENTION

The field of invention relates generally to firearms. More particularly, it pertains to an interchangeable modular chamber system for a firearm insert mated to a rifle barrel to allow the headspace to be optimized for using different cartridges of the same caliber and to allow for the sacrificial replacement of the throat area of a barrel.

BACKGROUND

Several military programs, such as the Precision Sniper Rifle or the Advanced Sniper Rifle, sponsored by USSOCOM, are attempting modularity of the caliber or cartridge fired by a common rifle chassis using an interchangeable barrel approach. Obtaining a system with low dispersion (i.e., tight groups or good accuracy) is difficult in this approach, as interchangeability of barrels often means that some machining tolerances have to be loosened, and that the barrel nut is removed and reattached with each different barrel swap. This interchanging of the barrels introduces the potential for error and misalignment, ultimately resulting in poor accuracy. Interchangeable barrels also introduce more and heavier components, such as the need for carrying or maintaining multiple barrels.

In the distant past, when the US Army moved to the 7.62×51 mm (.308 caliber) M14, which fired a shorter cartridge than the previous standard Ml .30-06, the US Navy decided to stay with the Ml .30-06 chambered rifle and simply use a chamber insert to allow for the shorter .308 cartridge to be fired in the Ml. In that system the chamber insert for the Ml was permanently installed by being machine pressed into the existing chamber, thereby permanently converting the Ml from a .30-06 rifle to a .308 rifle. No operator modification was enabled in this scenario.

SUMMARY OF THE INVENTION

The present invention relates to an interchangeable modular chamber system for a firearm. The system includes a firearm receiver, a barrel comprising lands and grooves, a chamber insert sleeve comprising lands and grooves, an index pin, a locking collar, and a recoil lug. The barrel is threaded into the receiver with the chamber insert sleeve positioned within the barrel. The chamber insert sleeve is indexed to align the lands and grooves of the chamber insert sleeve with those of the barrel. The locking collar and recoil lug are threaded onto the external threads of the barrel and are adjustable to optimize the headspace for different cartridges of the same caliber and to allow for the sacrificial replacement of the throat area of a barrel.

According to an illustrative embodiment of the present disclosure, it is an object of the invention to provide an interchangeable modular chamber system for a firearm mated to a rifle barrel that has all of the advantages of the prior art and none of the disadvantages.

According to an illustrative embodiment of the present disclosure, it is an object of the invention to provide an interchangeable modular chamber system for a firearm that allows the headspace to be adjusted According to a further illustrative embodiment of the present disclosure, it is an object of the invention to provide an interchangeable modular chamber system for a firearm that is optimized for using different cartridges of the same caliber According to a yet another illustrative embodiment of the present disclosure, it is an object of the invention to provide an interchangeable modular chamber system for a firearm that allows for the sacrificial replacement of the throat area of a barrel.

According to a still another illustrative embodiment of the present disclosure, it is an object of the invention to provide an interchangeable modular chamber system for a firearm that moves the bore throat to the chamber insert sleeve rather than the barrel itself.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Generally, provided is an interchangeable modular chamber system for a firearm and one or more cartridge types comprising: a firearm receiver comprising internal threads, a barrel comprising external threads and internal lands and grooves, a chamber insert sleeve comprising lands and grooves, an index pin, a locking collar, and a recoil lug. The barrel is threaded into the receiver with the chamber insert sleeve positioned within the barrel. The chamber insert sleeve is indexed such that the lands and grooves of the chamber insert sleeve align with the lands and grooves of the barrel. The chamber insert sleeve and the barrel each have an indexed radius cut recess matching a diameter of the index pin, wherein the index pin locks and aligns the lands and grooves of the chamber insert sleeve with the lands and grooves of the barrel. The locking collar and the recoil lug are threaded onto the external threads of the barrel and are positioned to set headspace for a desired cartridge, such that the headspace can be set in a first position to enable firing of a first cartridge type and can be set in a second position to enable firing of a second cartridge type.

Figure 1:
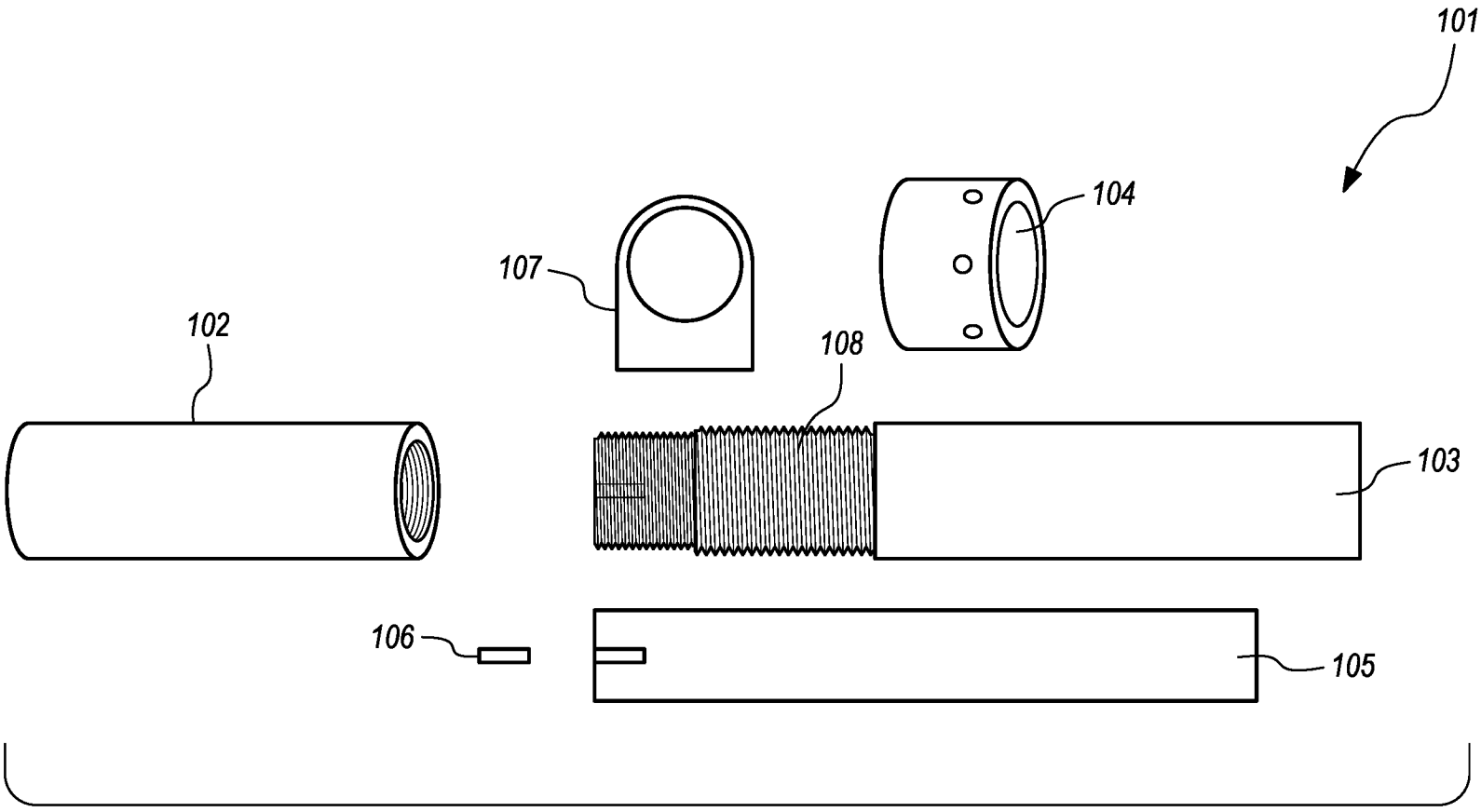
FIG. 1 shows an exploded view of the interchangeable modular chamber system.

FIG. 1 shows an exploded view of the interchangeable modular chamber system 101. The interchangeable modular chamber system 101 can be utilized with any firearm type. In one illustrative embodiment, the interchangeable modular chamber system 101 can be utilized with a rifle, carbine, pistol caliber carbine, pistol, and the like. In an illustrative embodiment, the interchangeable modular chamber system 101 includes a firearm receiver 102 comprising internal threads, a barrel 103 comprising external threads and internal lands and grooves, a chamber insert sleeve 105 comprising lands and grooves, an index pin 106, a locking collar 104, and a recoil lug 107. The receiver 102 as shown is a threaded blank representing a conventional firearm receiver. As can be appreciated, a conventional receiver can be used with the system. The barrel 103 as shown is threaded 108 to fit both the receiver 102 and the locking collar 104. In an illustrative embodiment, the barrel 103 is a conventional rifled barrel that includes spiraling grooves cut or pressed into the bore. The metal ridges disposed between the grooves are called lands. Together, the grooves and lands comprise the "rifling." The external threads 108 are also used to set the headspace for the cartridge/insert, which will be discussed in greater detail below.

Figure 2:
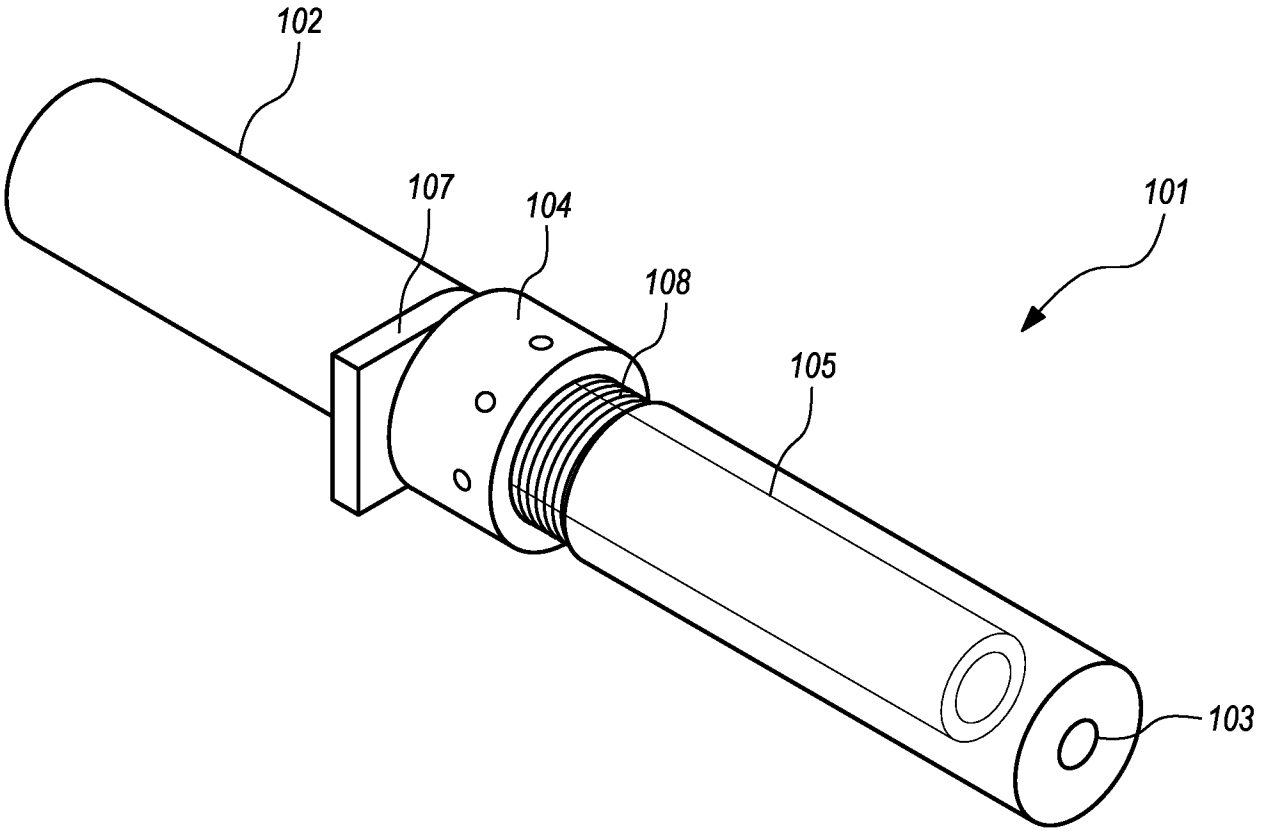
FIG. 2 shows a perspective view of the assembled interchangeable modular chamber system.

FIG. 2 shows a perspective view of the assembled interchangeable modular chamber system 101. The chamber insert sleeve 105 is indexed to ensure that lands and grooves of the chamber insert sleeve 105 align perfectly with the lands and grooves of the barrel 103. The indexing is accomplished by the index pin that fits within an indexed radius cut recess matching a diameter of the index pin, which will be shown and described in greater detail below. The index pin locks and aligns the lands and grooves of the chamber insert sleeve 105 with the lands and grooves of the barrel 103. The interchangeable modular chamber system 101 is held in place with the locking collar 104 and recoil lug 107, which are threaded onto the external threads 108 of the barrel 103. In one illustrative embodiment, the locking collar 104 and recoil lug 107 are positioned on the barrel 103 to set headspace for a desired cartridge, such that the headspace can be set in a first position to enable firing of a first cartridge type and can be set in a second position to enable firing of a second cartridge type.

Figure 3:
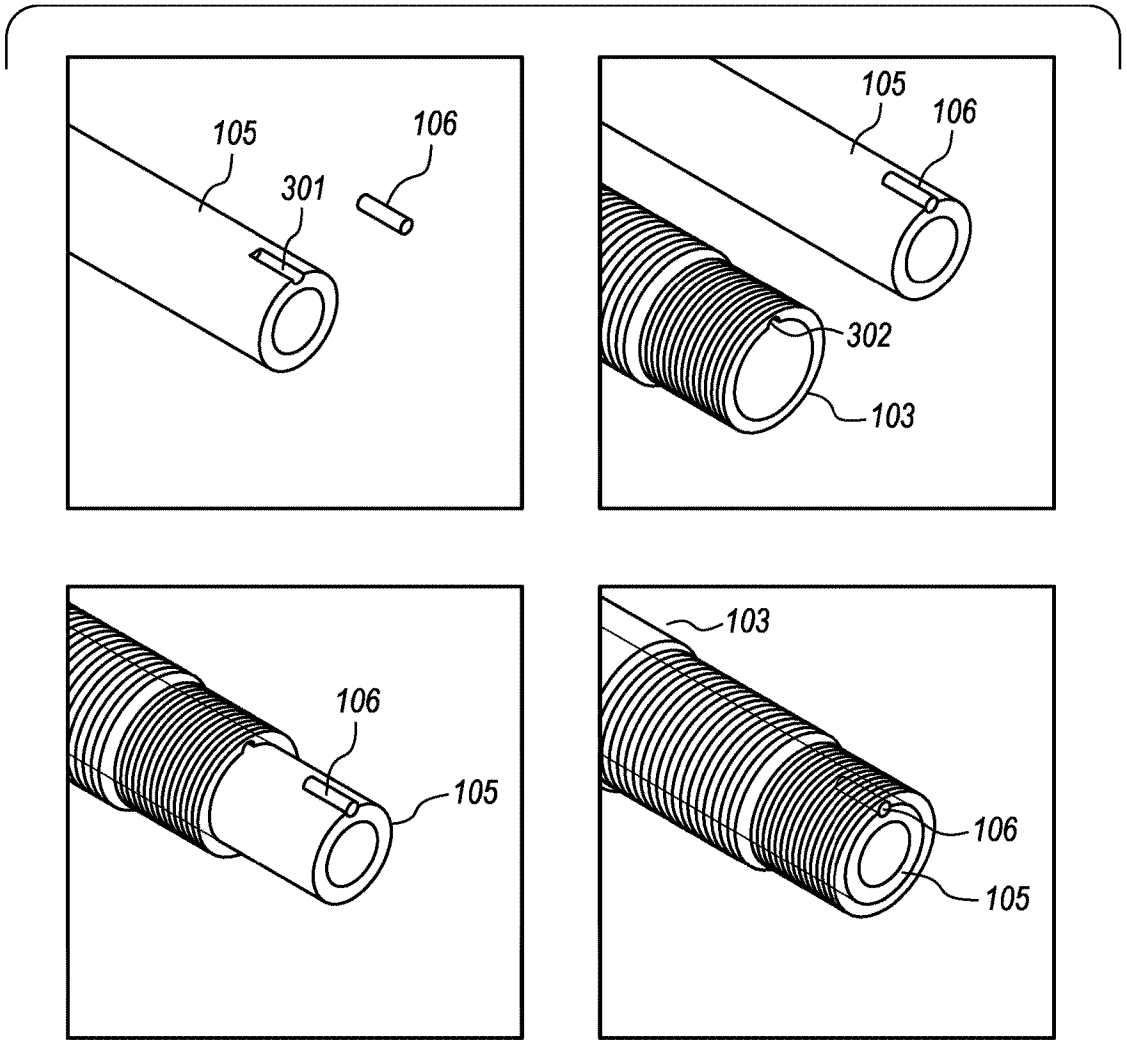
FIG. 3 shows the chamber insert sleeve with the chamber insert sleeve opening end that engages the barrel bore.
Figure 4:
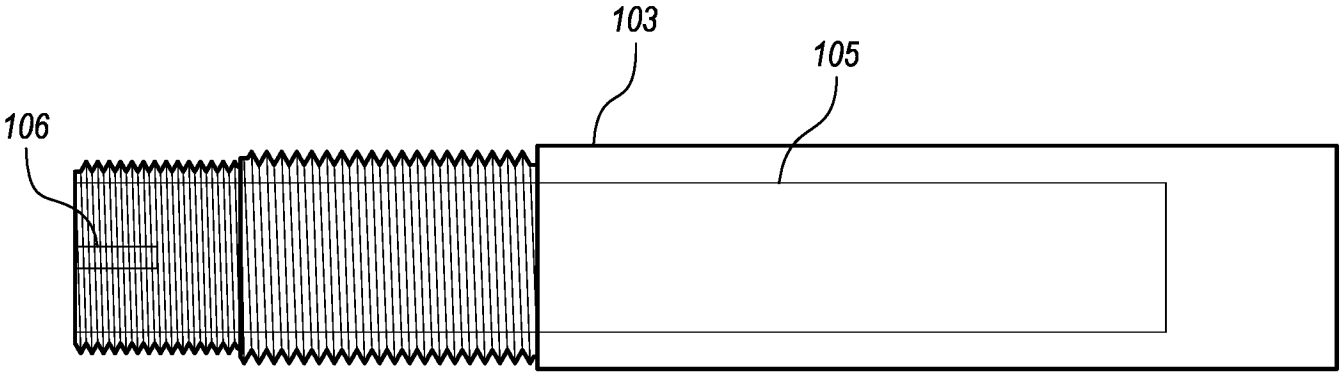
FIG. 4 shows the modular chamber insert sleeve inserted into a barrel.

FIG. 3 shows the insert 105, index pin 106, and barrel 103, and FIG. 4 shows the insert sleeve 105 inserted into a barrel 103. Indexing is accomplished by the index pin 106 that fits within a sleeve recess 301 and a barrel recess 302 that match the diameter of the index pin 106. The index pin 106 is inserted into the sleeve recess 301 and barrel recess 302, which in turn locks and aligns the lands and grooves of the chamber insert sleeve 105 with the lands and grooves of the barrel 103. As can be appreciated, the index pin 106 prevents the sleeve from rotating within the barrel and placing the lands and grooves out of alignment. Proper alignment of the lands and grooves enables the projectile to spin with a spiral trajectory as it exits the muzzle, thereby ensuring the projectile keeps it point first in flight to enhance accuracy.

Figure 5:
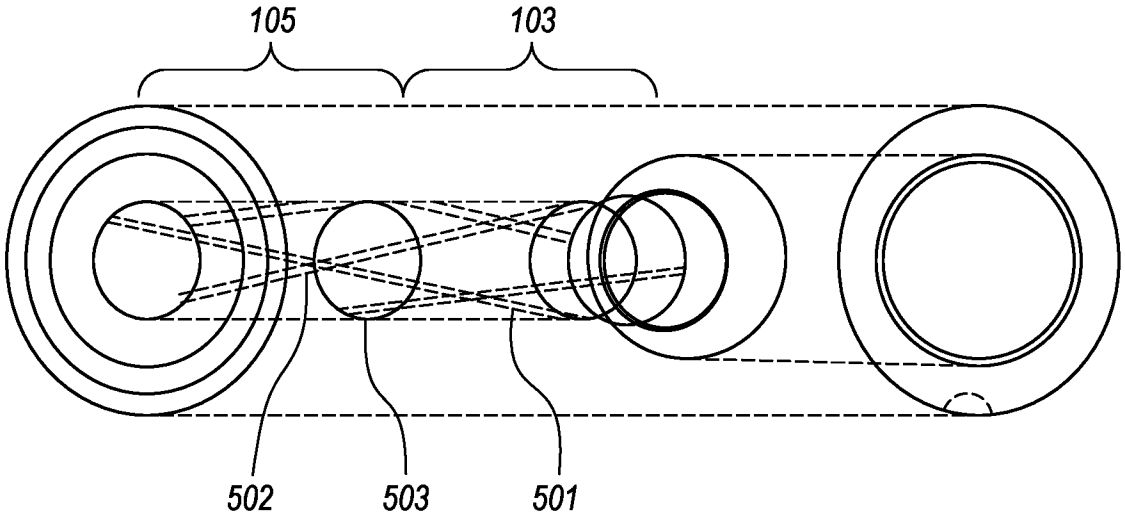
FIG. 5 shows an interior view of the lands and grooves of the chamber insert sleeve 105 aligned with the lands and grooves of the barrel.

FIG. 5 shows an interior view of the lands and grooves 501 of the chamber insert sleeve 105 aligned with the lands and grooves 502 of the barrel 103. The chamber insert sleeve 105 is positioned within the barrel 103 with the insert muzzle end 503 depicted. The muzzle end 503 shows the junction between the lands and grooves 502 of the barrel 103 and the lands and grooves 501 of the chamber insert sleeve 105. The alignment created by the index pin, as shown in FIGS. 3 and 4 provides a continuous rifling pattern throughout the entire insert sleeve 105 and barrel 103 to ensure proper twist of the cartridge as it exits the muzzle end of the barrel 103.

Figure 6:
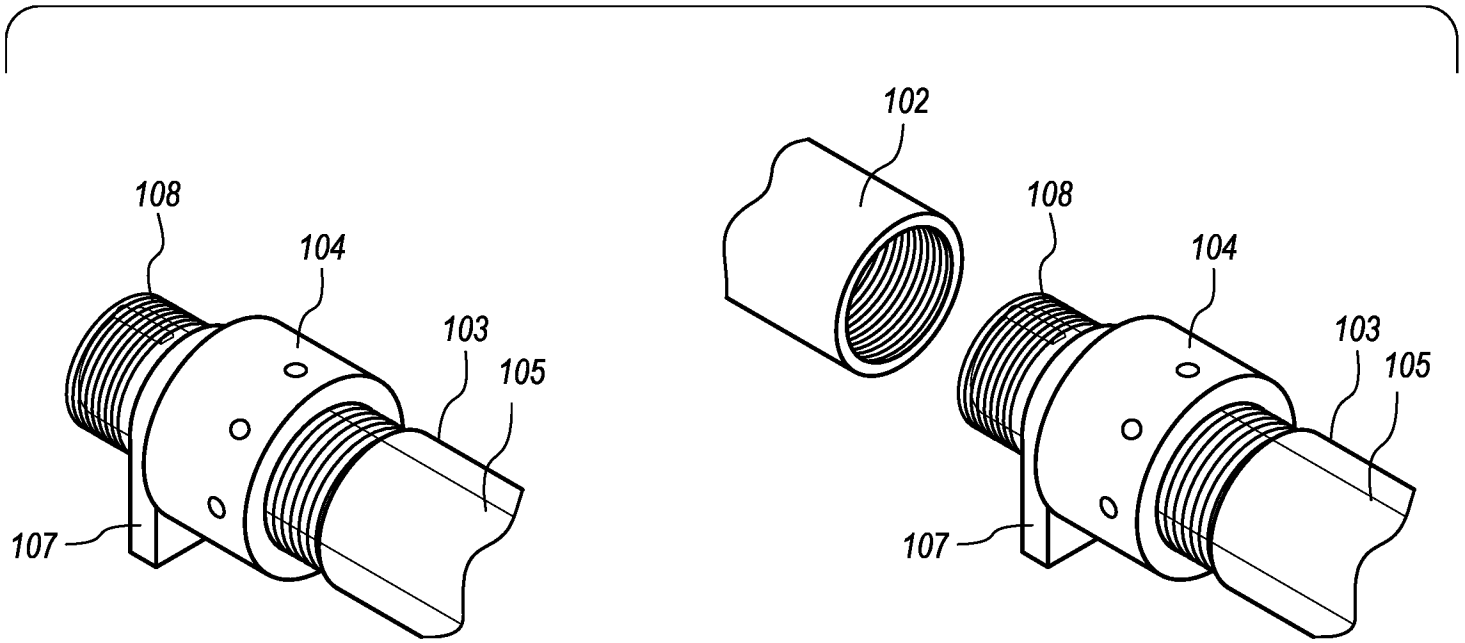
FIG. 6 shows the locking collar and a recoil lug installed on the external threads of the barrel for setting the proper headspace.
Figure 7:
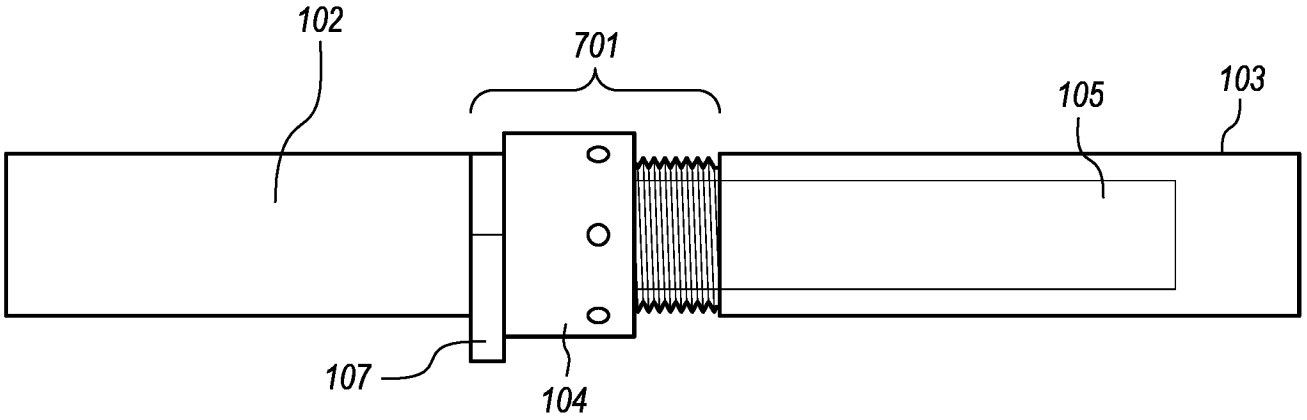
FIG. 7 shows a view of the assembled interchangeable modular chamber system.

FIG. 6 shows the locking collar 104 and a recoil lug 107 installed on the external threads 108 of the barrel 103 for setting the proper headspace, and FIG. 7 shows a view of the assembled interchangeable modular chamber system. The locking collar 104 and the recoil lug 107 are threaded onto the external threads 108 of the barrel 103 and are positioned to set headspace 701 for a desired cartridge, such that the headspace 701 can be set in a first position to enable firing of a first cartridge type and can be set in a second position to enable firing of a second cartridge type. As can be appreciated, headspace is the distance from the bolt face of a firearm to the base of the cartridge case when the bolt is closed and its locking lugs are fully engaged with the lugs of the receiver. In an illustrative embodiment, the headspace 701 is adjusted by adjusting the threading between the receiver 107 and the barrel 103. In an illustrative embodiment, loosening the threads between the receiver 107 and the barrel 103 increases the headspace 701, and tightening the threads between the receiver 107 and the barrel 103 decreases the headspace 701. Once the desired headspace 701 is selected, the recoil lug 107 is snugged against the receiver 102 and the locking collar 104 is snugged against the recoil lug 107. As described above, the index pin maintains alignment between the lands and grooves of the chamber insert sleeve 105 and the lands and grooves of the barrel 103.

In an illustrative embodiment, the headspace can be optimized for cartridges of the same caliber, wherein the same rifle can be used to fire .308, .30-06, .300 WIN MAG, and .300 Norma MAG (same .30 diameter projectile). Similarly, in another illustrative embodiment, one rifle could be used to fire 6.5 Creedmore or .260 Remington (same .264 diameter projectile). In yet another illustrative embodiment, the headspace can be optimized for the same projectile of different weights, wherein the same rifle can be used to fire a 215 grain or a 220 grain 300 WIN MAG cartridge such that optimum accuracy could be obtained for that have different profiles, Ogive locations, and seating depths.

The inventive interchangeable modular chamber system has a multitude of military, law enforcement, and commercial uses. In illustrative embodiment, for military and law enforcement applications, the interchangeable modular chamber system can be utilized for training purposes. It is contemplated that training can be accomplished on a lower power, lower cost ammunition (i.e., a 7.62×51 or .308 cartridge), that is widely available and for which training ranges are currently established. Then, by switching out a chamber insert, an operator can adapt the same firearm for use with a higher power, longer range, more expensive cartridge (i.e., a .300 WINMAG or .300 Norma MAG).

In illustrative embodiment, for commercial applications, hunters and recreational/target shooters can shoot low cost ammunition or lower power ammunition more frequently at shorter ranges, or at smaller game animals, and use more expensive, longer range ammunition for longer ranges, larger game, or less frequent use. In another illustrative embodiment, a hunter can utilize multiple cartridges in one rifle (i.e., .308, .30-06, .300 WIN MAG, and .300 Norma MAG), thus reducing the cost associated with purchasing multiple calibers and multiple different rifles, along with scopes and accessories.

In another illustrative embodiment, inventive interchangeable modular chamber system extends the life of a firearm. As is well known, barrel erosion and ultimately the limited life of a rifle barrel is almost exclusively due to erosion of the lands/grooves at the "throat" area of the rifle, where the chamber transitions to the inner bore of the rifle. This area experiences the highest pressures and temperatures in the firing sequence and encounters the metallic projectile colliding with and inscribing itself into the lands/grooves of the bore. As can be appreciated, in a conventional firearm design, the chamber is reamed out of the barrel itself, meaning that the entire barrel must be replaced when throat erosion gets beyond a certain point.

In an illustrative embodiment, the interchangeable modular chamber system allows the sacrificial replacement of the area of the bore throat which is now contained within the chamber insert sleeve rather than the barrel itself. The chamber insert sleeve can be removed and replaced upon wearing down to below specification, thereby extending barrel life by a large margin. Barrel life extension will prolong the life of a rifle for consumers, law enforcement, and will help in military training scenarios where snipers "use up" their barrel life in training, wherein they must have rifles re-barreled at a depot facility.

Although the invention has been described in detail with reference to certain preferred embodiments, variations and modifications exist within the spirit and scope of the invention as described and defined in the following claims.

The invention claimed is:

1. An interchangeable modular chamber system for a firearm and one or more cartridge types comprising:

a firearm receiver comprising internal threads;

a barrel comprising a bore end, a muzzle end, a longitudinal barrel recess positioned at said bore end, and external threads;

a chamber insert sleeve comprising a bore end, a muzzle end, and a longitudinal sleeve recess positioned at said bore end;

an index pin;

a locking collar; and a recoil lug;

wherein said chamber insert sleeve is positioned within said barrel and said index pin is inserted between said longitudinal sleeve recess and said longitudinal barrel recess at said bore end to lock and align said chamber insert sleeve with said barrel;

wherein said locking collar and said recoil lug are threaded onto said barrel and are positioned to set headspace for a desired cartridge;

wherein said headspace can be set in a first position to enable firing of a first cartridge type and can be set in a second position to enable firing of a second cartridge type.

2. The system of claim 1, wherein said interchangeable modular chamber system can be utilized with a rifle, a carbine, a pistol caliber carbine, and a pistol.

3. The system of claim 1, wherein said index pin prevents said sleeve from rotating within said barrel.

4. The system of claim 1, wherein said index pin aligns said insert sleeve and said barrel to provide a continuous rifling pattern along the internal length of insert sleeve and said barrel.

5. The system of claim 1, wherein said headspace is adjusted by adjusting spacing between said receiver internal threads and said barrel external threads.

6. The system of claim 5, wherein said headspace is increased by loosening said receiver internal threads and said barrel external threads.

7. The system of claim 5, wherein said headspace is decreased by tightening said receiver internal threads and said barrel external threads.

8. The system of claim 5, wherein said recoil lug is snugged against said receiver and said locking collar is snugged against said recoil lug to set said headspace.

9. An interchangeable modular chamber system for a firearm and one or more cartridge types comprising:

a firearm receiver comprising internal threads;

a barrel comprising a bore end, a muzzle end, a longitudinal barrel recess positioned at said bore end, external threads, and internal lands and grooves;

a chamber insert sleeve comprising a bore end, a muzzle end, a longitudinal sleeve recess positioned at said bore end, and lands and grooves;

an index pin;

a locking collar; and a recoil lug;

wherein said chamber insert sleeve is positioned within said barrel and said index pin is inserted between said longitudinal sleeve recess and said longitudinal barrel recess at said bore end to lock and align said chamber insert sleeve with said barrel;

wherein said chamber insert sleeve is indexed such that said lands and grooves of said chamber insert sleeve align with said lands and grooves of said barrel;

wherein said chamber insert sleeve further comprises a sleeve recess and said barrel comprises a barrel recess that match a diameter of said index pin, wherein said index pin locks and aligns said lands and grooves of said chamber insert sleeve with said lands and grooves of said barrel;

wherein said locking collar and said recoil lug are threaded onto said external threads of said barrel and are positioned to set headspace for a desired cartridge;

wherein said headspace can be set in a first position to enable firing of a first cartridge type and can be set in a second position to enable firing of a second cartridge type.

10. The system of claim 9, wherein said interchangeable modular chamber system can be utilized with a rifle, a carbine, a pistol caliber carbine, and a pistol.

11. The system of claim 9, wherein said index pin prevents said sleeve from rotating within said barrel.

12. The system of claim 9, wherein said index pin aligns said insert sleeve and said barrel to provide a continuous rifling pattern along the internal length of insert sleeve and said barrel.

13. The system of claim 9, wherein said headspace is adjusted by adjusting spacing between said receiver internal threads and said barrel external threads.

14. The system of claim 13, wherein said headspace is increased by loosening said receiver internal threads and said barrel external threads.

15. The system of claim 13, wherein said headspace is decreased by tightening said receiver internal threads and said barrel external threads.

16. The system of claim 13, wherein said recoil lug is snugged against said receiver and said locking collar is snugged against said recoil lug to set said headspace.

* * * * *